US005216369A

United States Patent [19]

Toyama

[11] Patent Number: 5,216,369

[45] Date of Patent: Jun. 1, 1993

[54] IGNITION OCCURRENCE DETECTING DEVICE FOR USE IN AN IGNITION APPARATUS

[75] Inventor: Koichi Toyama, Kariya, Japan

[73] Assignee: Nippondenso Co., Ltd., Kariya, Japan

[21] Appl. No.: 870,753

[22] Filed: Apr. 20, 1992

Related U.S. Application Data

[63] Continuation of Ser. No. 482,934, Apr. 17, 1990, abandoned.

[30] Foreign Application Priority Data

Feb. 22, 1989 [JP] Japan ..... 1-042152
Mar. 31, 1989 [JP] Japan ..... 1-82090
Oct. 27, 1989 [JP] Japan ..... 1-281500

[51] Int. Cl.[5] ..... F02P 17/00

[52] U.S. Cl. ..... 324/388; 324/390; 324/393

[58] Field of Search ..... 324/378-380, 324/382, 388, 390, 391, 402, 393, 394

[56] References Cited

U.S. PATENT DOCUMENTS 3,942,102 3/1976 Kuhn et al. ..... 324/399
4,008,430 2/1977 Blum ..... 324/402
4,117,807 10/1978 Barnard ..... 123/478
4,331,921 5/1982 Walker .
4,331,922 5/1982 Walker .
4,333,054 6/1982 Walker .
4,760,341 7/1988 Skerritt ..... 324/379

FOREIGN PATENT DOCUMENTS 0020067 12/1980 European Pat. Off. .
0020068 12/1980 European Pat. Off. .
0020069 12/1980 European Pat. Off. ..... 324/388
56-143326 11/1981 Japan .

OTHER PUBLICATIONS

Howard Weber, "Electronic Breakerless Inductive Storage Ignition," Automotive Electronics, Feb. 1974, pp. 245-254.

Patent Abstracts fo Japan, vol. 10, No. 378 (M-546) [2435], Dec. 17, 1986.

F. G. Spreadbury, Electrical Ignition Equipment, pp. 76-77 Dec. 1954.

Eric H. Ford, Opto-Electronic Ignition, Automotive Engineering Congress, Feb. 1974.

*Primary Examiner*—Jack B. Harvey

*Attorney, Agent, or Firm*—Cushman, Darby & Cushman

[57] ABSTRACT

An ignition detecting device for use in an internal combustion engine. An ignition surge current detector detects an ignition surge current due to capacitive discharge of the ignition coil. A comparator compares an output voltage detected by the ignition surge current detector with a predetermined reference voltage to detect accurately occurrence or non-occurrence of ignition spark.

16 Claims, 8 Drawing Sheets

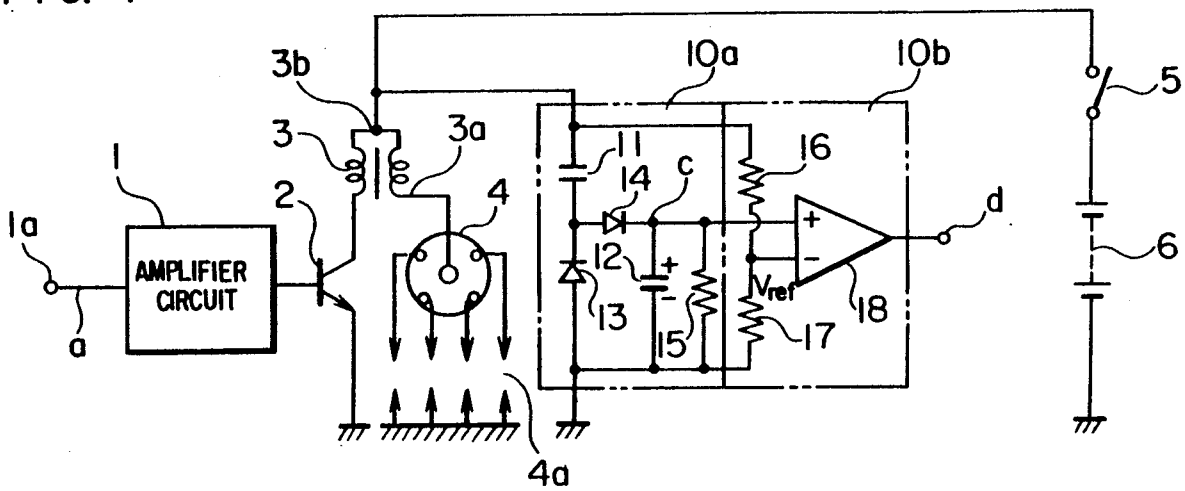
FIG. 1
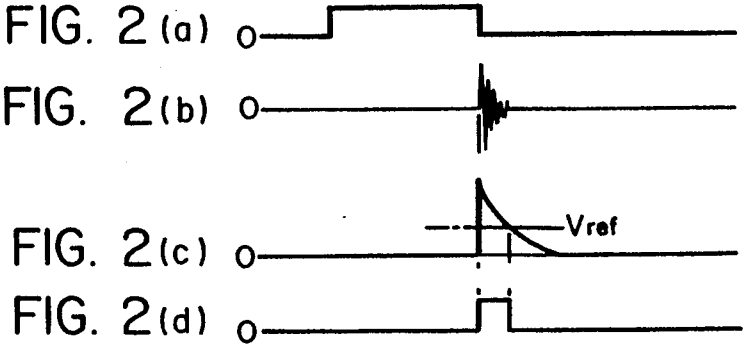
FIG. 2(a)
FIG. 2(b)
FIG. 2(c)
FIG. 2(d)

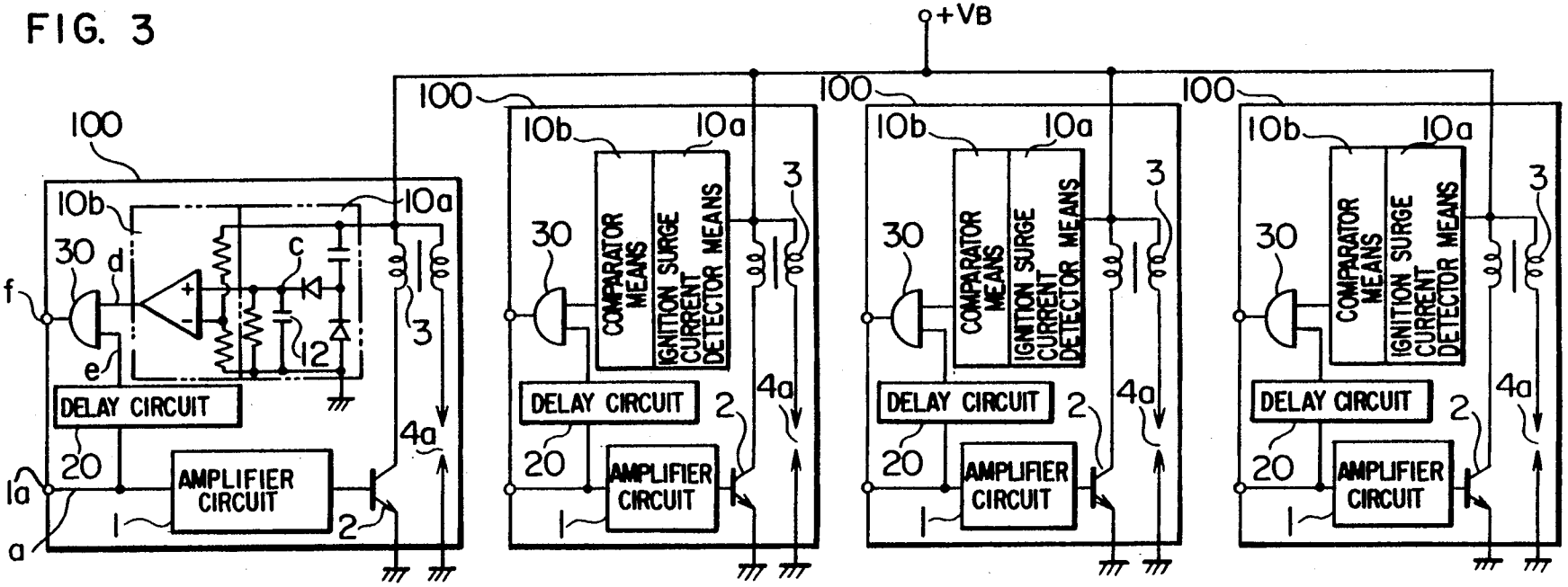
FIG. 3
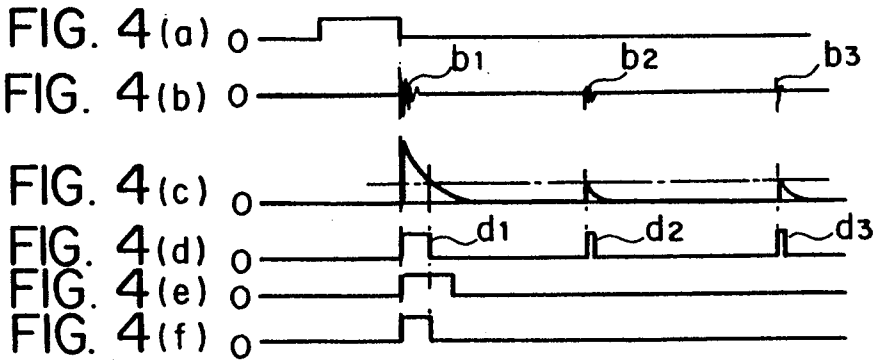
FIG. 4(a)
FIG. 4(b)
FIG. 4(c)
FIG. 4(d)
FIG. 4(e)
FIG. 4(f)

t1
t2

IGNITION OCCURRENCE DETECTING DEVICE FOR USE IN AN IGNITION APPARATUS

This is a continuation of application Ser. No. 07/482,934, filed on Apr. 17, 1990, which was abandoned.

BACKGROUND OF THE INVENTION

1. Field of the Invention

The present invention relates to an ignition detecting device for detecting the presence or absence of ignition spark produced by an ignition apparatus for internal combustion engine mainly used in automobiles.

2. Description of the Related Art

With recent development of electronic implementation of fuel injection apparatuses, ignition apparatuses, exhaust gas control apparatuses and the like, it has been emphasized that an adverse influence of these apparatuses on an exhaust gas, when they are in failure, should be taken into careful consideration.

This type of apparatus should function to determine whether ignition spark is produced normally in combustion chambers of an internal combustion engine. Therefore, several proposals have hitherto been made to determine whether normal ignition spark is produced or not by electronically analyzing a high voltage output waveform on the secondary side of an ignition coil (for example, U.S. Pat. No. 3,942,102 specification), to detect a flyback voltage produced at the collector of an output transistor for turning on and off a primary winding current of an ignition coil (for example, JP-A-56-143326), etc.

The former proposal can detect accurately the presence or absence of the occurrence of ignition spark, however, since it detects a high voltage output waveform appearing on the secondary side of the ignition coil, sufficient insulation becomes necessary for the path through which the secondary side high voltage is introduced into an electronic circuit, and, particularly, there has been a problem that application of this proposal to vehicle-mounted apparatuses is difficult from the viewpoint of the structure and cost.

The latter proposal, on the other hand, detects a flyback voltage produced at the collector of an output transistor for turning on and off a primary winding current of the ignition coil, so that it does not require to introduce a secondary side high voltage into the electronic circuit. However, there is a problem that, whenever a high voltage is produced at the secondary side of the ignition coil, a flyback voltage is generated even in the absence of ignition spark, so that, even when the ignition plug requires a voltage higher than the secondary side voltage of the ignition coil or even when a high tension cord is disconnected and hence no ignition spark is generated at the ignition plug, an erroneous detection is made.

SUMMARY OF THE INVENTION

An object of the present invention is to solve the afore-mentioned problems and detect the presence of absence of ignition spark correctly.

In order to accomplish the above object, the present invention provides an ignition detecting device for detecting the presence or absence of ignition spark in an ignition apparatus constructed to generate a high voltage for producing ignition spark in a secondary winding of an ignition coil by turning on and off a primary current flowing through a primary winding of the ignition coil, the primary winding being connected to a primary side circuit and the secondary winding being connected to a secondary side circuit, which ignition detecting device comprises ignition surge current detector means for detecting an ignition surge current due to capacitive discharge of the ignition coil, and comparator means responsive to an output signal of the ignition surge current detector means for detecting an ignition surge current in excess of predetermined value.

In the above-described construction of the ignition detecting device the primary side circuit includes a DC power supply having one electrode connected to one end of the primary winding and the other electrode grounded and switching means having one end connected to the other end of the primary winding and the other end grounded and responsive to an ignition signal thereby to be turned on and off, the secondary side circuit includes ignition plugs one end of each of which is connected to one end of the secondary winding and the other end of each of which is grounded, the other end of the secondary winding being connected to the one end of the primary winding, the ignition surge current detector means includes a first series circuit of a first diode and a first capacitor charged through the first diode by an ignition surge current of one polarity generated in the secondary side circuit, which first series circuit is connected between the ground and a junction between the primary and secondary windings, and a second series circuit of a second diode and a second capacitor charged through the second diode by an ignition surge current of the other polarity generated in the secondary side circuit, which second series circuit is connected between the ground and a junction between the first diode and the first capacitor, and the comparator means compares a voltage on the secondary capacitor with a predetermined value.

Further, the ignition surge current detector means may include a detection coil wound on a power supply line of the primary side circuit to detect an ignition surge current in the power supply line, and integration means for rectifying and integrating a voltage induced in the detection coil.

In this case, the detection coil may be wound on the power supply line interconnecting the junction between the primary and secondary windings with the DC power supply.

As an alternative, the detection coil may be wound on a power supply line of an amplifier circuit for amplifying the ignition signal.

In a further alternative, the detection coil may be wound on a power supply line of a smoothing capacitor comprised in the amplifier circuit.

In a modification of the construction, the ignition surge current detector means may include a series circuit of a diode and a capacitor charged through this diode by an ignition surge current of one polarity generated in the secondary side circuit, which series circuit is connected in parallel with a ground line of the primary side circuit, and the comparator means compares a voltage on the capacitor with a predetermined value.

In a further modification of the construction, the ignition detecting device for use in internal combustion engines has a plurality of ignition coils corresponding to the number of cylinders of an internal combustion engine, a plurality of ignition surge current detector means and a plurality of comparator means are provided in association with each of the ignition coils, and means is provided for validating only an output signal detected by each comparator means at normal ignition timing. In another modification of the construction, an AC coupling capacitor is connected between the ungrounded electrode of the DC power supply and a ground line in the ground path of the comparator means, which ground path is provided separately from a ground path of an igniter including the amplifier circuit for amplifying the ignition signal and the output transistor responsive to an output signal of the amplifier circuit to turn on and off a primary winding current, so that an ignition surge current generated in the ignition coil is conducted to the ground line through the AC coupling capacitor, and the ignition surge current detector means and the comparator means are provided separately from the igniter to form an ignition sensor.

In an alternative, an AC impedance element may be comprised in the ground line.

In a separate modification of the construction, a single ignition sensor may be employed commonly to a plurality of ignition coils provided corresponding to the respective engine cylinders, and individual cylinder ignition determining means may be provided to perform a logical operation on an output signal of the ignition sensor and an ignition signal for each of the cylinders to thereby effect ignition detection for individual cylinders.

In the ignition detecting device of an ignition apparatus of the present invention, an ignition surge current due to capacitive discharge by the ignition coil is detected by the ignition surge current detector means, and the comparator means is responsive to the output signal of the ignition surge current detector means to detect an ignition surge current in excess of a predetermined value, thereby detecting the presence or absence of ignition spark.

In the ignition surge current detector means, the first capacitor may be charged with an ignition surge current of one polarity generated in the secondary side circuit through the first diode connected in series with the first capacitor between the ground and the junction between the primary and secondary windings of the ignition coil, and the second capacitor may be charged with an ignition surge current of the other polarity generated in the secondary side circuit through the second diode connected in series with the second capacitor between the ground and the junction between the first diode and the first capacitor. Then, a voltage on the second capacitor may be compared with a predetermined value by the comparator means to thereby detect the presence or absence of ignition spark.

As an alternative construction of the ignition surge current detector means, a detection coil wound on the power supply line of the primary side circuit may be used to detect an ignition surge current in the power supply line, and a voltage induced in the detection coil may be rectified and integrated by integration means. Then, the rectified and integrated voltage may be compared with a predetermined value by the comparator means to detect the presence or absence of ignition spark.

As a further alternative construction of the ignition surge current detector means, an ignition surge current of one polarity generated in the secondary side circuit may be used to charge a capacitor through a diode connected in parallel with the ground line of the primary side circuit. Then, a voltage on the capacitor may be compared with a predetermined value by the comparator means to detect the presence or absence of ignition spark.

Further, when the ignition detecting device of the present invention is applied to an ignition apparatus of an internal combustion engine which ignition apparatus has a plurality of ignition coils corresponding to the number of cylinders of the internal combustion engine, a plurality of ignition surge current detector means and a plurality of comparator means may be provided in association with each of the ignition coils to detect an ignition surge current due to capacitive discharge by each ignition coil, and each comparator means may be used to validate only an output signal detected at normal ignition timing, thereby preventing erroneous detection of noises due to capacitive discharge by ignition coils for other cylinders generated in the primary side circuit.

Further, the AC coupling capacitor may be connected between the ground line in a ground path of the comparator means, which is provided separately from the ground path of the igniter, and an ungrounded electrode of the DC power supply so that an ignition surge current generated by the ignition coil is conducted to the ground line through the AC coupling capacitor, and the ignition surge current detector means and comparator means may be provided separately from the igniter to form an ignition sensor which detects an ignition surge current flowing through the ground line.

As a modification of the construction, an AC impedance element may be comprised in the ground line thereby to add an AC impedance to that of the ground line per se.

As a further modification of the construction, a single ignition sensor may be provided commonly to the plurality of ignition coils provided corresponding to the respective engine cylinders, and an output signal of the ignition sensor and an ignition signal for each cylinder may be subjected to a logical operation by individual cylinder ignition determining means to thereby effect ignition detection for each of the engine cylinders.

BRIEF DESCRIPTION DRAWINGS

FIG. 1 is an electric circuit diagram illustrating a first embodiment of an ignition detecting device of the present invention;

FIGS. 2(*a*)–2(*d*) are waveform diagrams useful for explaining the operation of the device shown in FIG. 1.

FIG. 3 is an electric circuit diagram illustrating a second embodiment of the device of the present invention.

FIGS. 4(*a*)–4(*f*) are waveform diagrams useful for explaining the operation of the device shown in FIG. 3.

Figure 11:
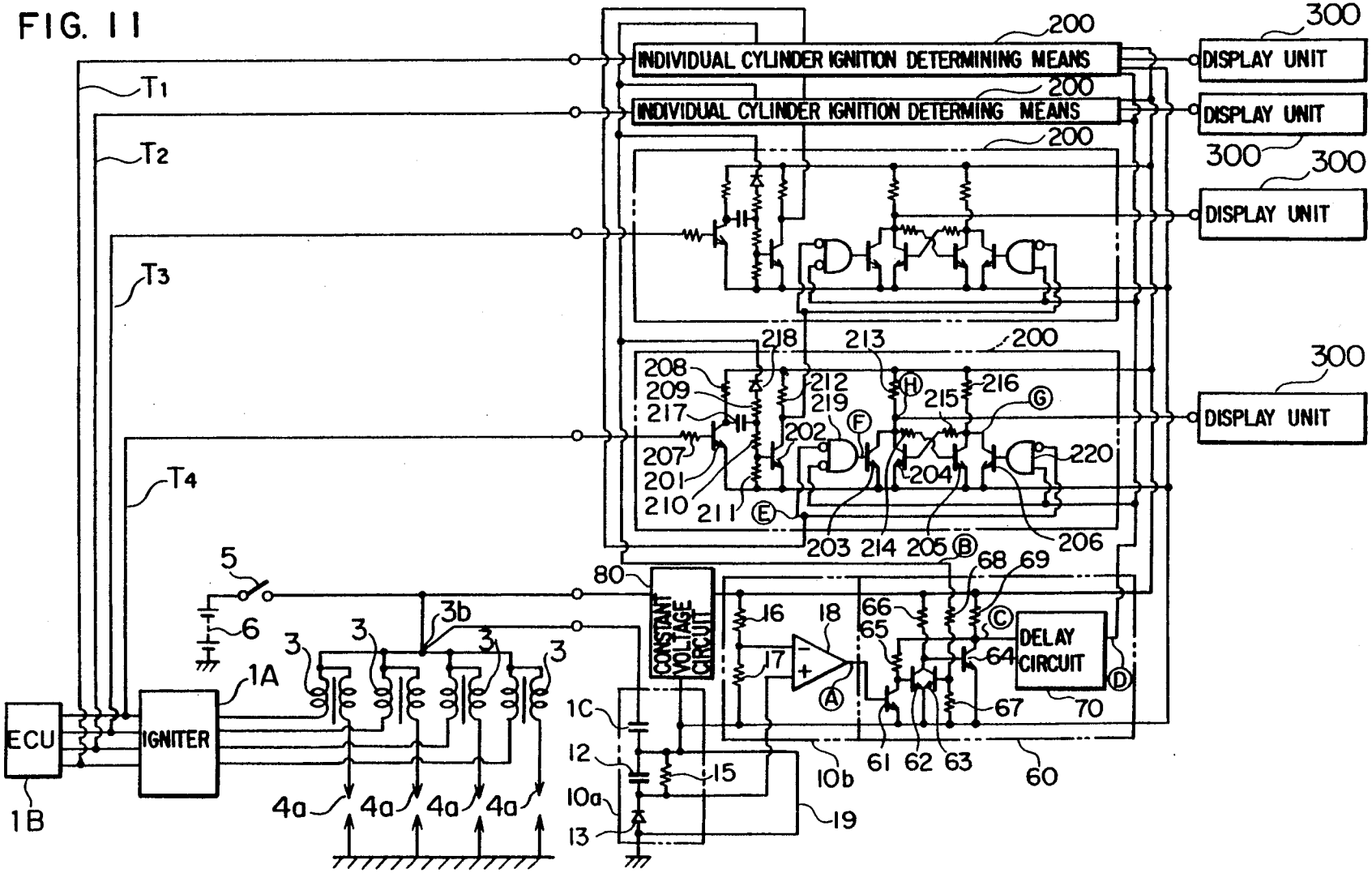
FIG. 11 is an electric circuit diagram illustrating a seventh embodiment of the device of the present invention.
Figures 12, 12A, 12B, 12C, 12D, 12E, 12F, 12G, 12H:
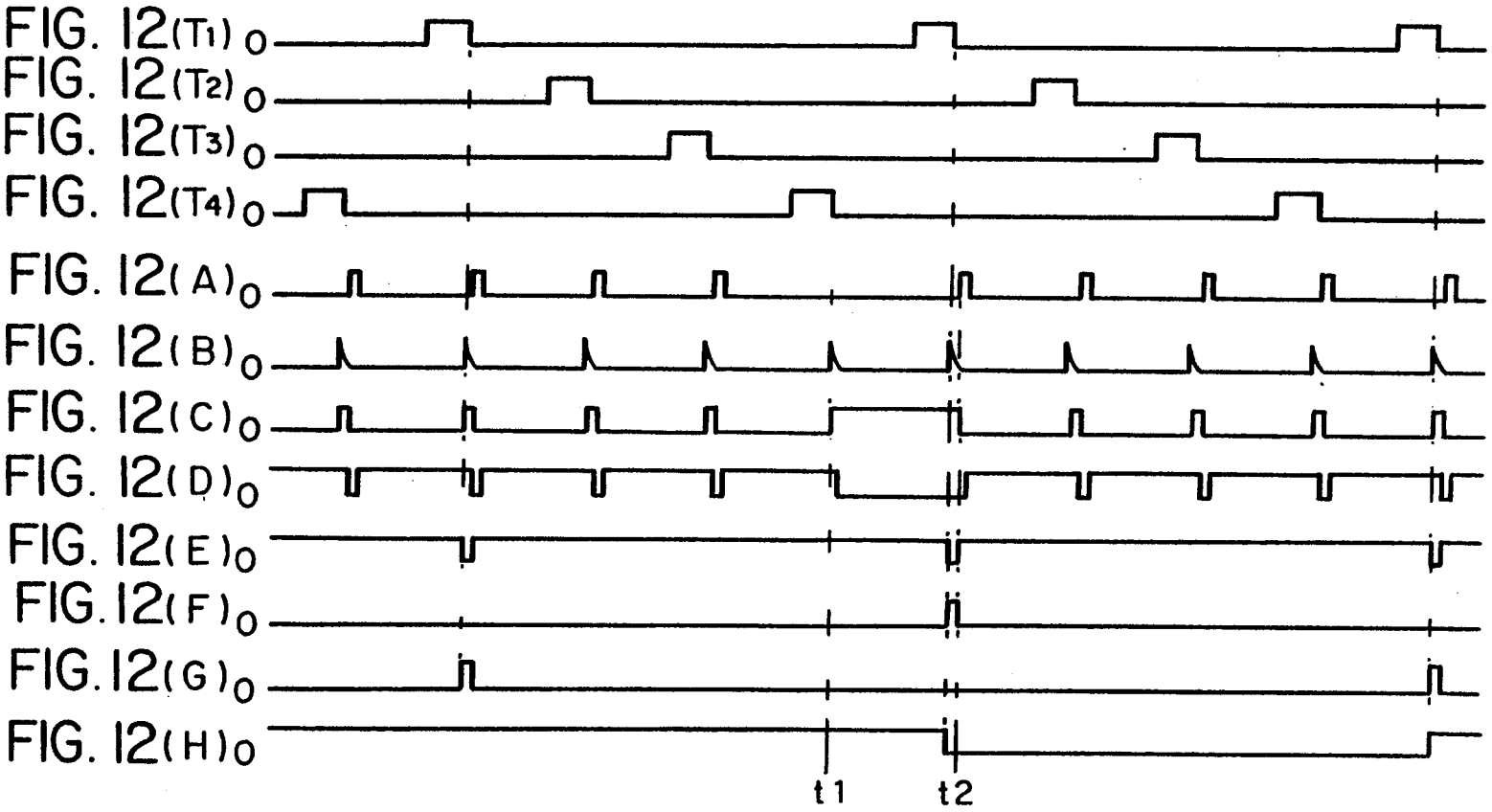

FIGS. 12(*a*)–12(*h*) are waveform diagrams illustrating waveforms appearing at various portions of the device shown in FIG. 11 which is useful for explaining the operation of the device.

FIG. 15 is an electric circuit diagram illustrating an eighth embodiment of the device of the present invention.

DESCRIPTION OF THE PREFERRED EMBODIMENTS

A first embodiment of the invention will be described with reference to an electric circuit diagram shown in FIG. 1 and operation waveform diagrams shown in FIGS. 2(*a*)–(*d*).

In FIG. 1, reference numeral 1 designates an amplifier circuit for amplifying an ignition signal inputted to an input terminal 1*a*, and 2 an output transistor which is turned on and off by the output signal of the amplifier circuit 1. Designated by 3 is an ignition coil having a primary winding, a current in which is turned on and off by the output transistor 2, and a secondary winding, one and of which is connected to a positive polarity terminal 3*b* of the primary winding and the other end 3*a* of which is connected to an ignition distributor 4 constructed to distribute a high voltage to a plurality of ignition plugs 4*a*. Designated by 5 is a key switch, and designated by 6 is a battery having a positive polarity terminal connected to the primary winding positive polarity terminal 3*b* via the key switch 5 and having a negative polarity terminal grounded.

Designated by 10*a* and 10*b* are ignition surge current detector means and comparator means, respectively, which constitute an ignition sensor and are constructed as will be described hereinafter. Denoted by 11 and 12 are respectively first and second capacitors, denoted by 13 and 14 are respectively first and second diodes, denoted by 15, 16 and 17 are respectively resistors, and denoted by 18 is a comparator.

The operation of the first embodiment of the present invention having the construction as mentioned above will now be described.

Firstly, when the output transistor 2 is turned on and then turned off by an ignition signal which is shown in 2(*a*) and applied through the amplifier circuit 1 to the output transistor 2, a high voltage is generated in the secondary winding of the ignition coil 3. This high voltage is supplied through the ignition distributor 4 to respective ignition plugs 4*a* to cause them to ignite normally and at that time an ignition surge current due to capacitive discharge caused by the ignition coil 3 is generated and flows from the ignition plugs 4*a* through the secondary winding of the ignition coil 3, the first capacitor 11, the second diode 14 and the second capacitor 12 to thereby charge the second capacitor 12 providing a polarity as shown in FIG. 1.

This surge current is a high frequency current of about 100 MHz, as shown in FIG. 2(*b*), having a peak value amounting to several amperes to several tens amperes. When a backward ignition surge current is generated, it flows from the ignition plugs 4*a* through the ground and the first diode 13 to discharge an electric charge stored in the first capacitor 11. In this manner, the high frequency ignition surge current is subjected to full wave rectification by the provision of the capacitors 11, 12 and diodes 13, 14 so as to charge the capacitor 12 as shown in FIG. 2(*c*). Subsequently, the charging voltage is compared in the comparator 18 with a reference voltage Vref determined by a voltage dividing ratio defined by the resistors 16 and 17, thereby producing an output pulse as shown in FIG. 2(*d*). Accordingly, in the event that ignition falls for a certain reason, the high frequency ignition surge current is not produced and no output pulse is generated. Therefore, by examining the presence or absence of the output pulse by any method not shown here, for example, by such a method as described in JP-A-56-143326, it is possible to detect the occurrence of a misfire.

Referring now to FIG. 3, a second embodiment of the present invention will be described. In the second embodiment, ignition coils 3 are provided in association with individual ignition plugs. This second embodiment is different from the first embodiment in that, in addition to the ignition sensor 10*a* and 10*b*, a delay circuit 20 and an AND circuit 30 are additionally provided for each cylinder, wherein the delay circuit is operative to generate a delay pulse of a predetermined time width in synchronism with the timing of falling of the ignition signal and it is formed by a falling time triggered monostable multivibrator, for example. Additional components are required for eliminating the influence of noises concomitant with ignition spark produced in adjacent cylinders when a plurality of ignition coils 3 are used. The noise eliminating operation will be described below. In addition to a normal ignition surge current b1 corresponding to an ignition signal of a particular cylinder as shown in FIG. 4(*a*), noise currents b2 and b3 due to ignition spark produced in adjacent cylinders appear, as shown in FIG. 4(*b*), to give charging voltages to the capacitor 12 as shown in FIG. 4(*c*). Consequently, the ignition sensor 10*a*, 10*b* will produce an output pulse signal containing, in addition to a normal pulse d1, pulses d2 and d3 due to the noise signals as shown in FIG. 4(*d*). However, by ANDing in the AND circuit 30 the pulses d1 to d3 and a delayed output pulse of the delay circuit 20 as shown in FIG. 4(*e*), the adverse influence of noises can be eliminated as shown in FIG. 4(*f*).

It is to be noted that, in the previously-described first embodiment, an output signal of the comparator 18 is outputted directly, however, it is a matter of course that the comparator may be used in combination with a monostable multivibrator circuit to attain similar effects.

Further, in the aforementioned second embodiment, though a logical operation was performed by using a delay pulse caused by an ignition signal, it is not necessary to be limited to this method, but a delay pulse signal may be utilized to mask the capacitor 12 directly. In other words, if the potential of the capacitor 12 is short-circuited at timings other than that of generation of a normal ignition surge current, similar effects are expected to be obtained.

Figure 5:
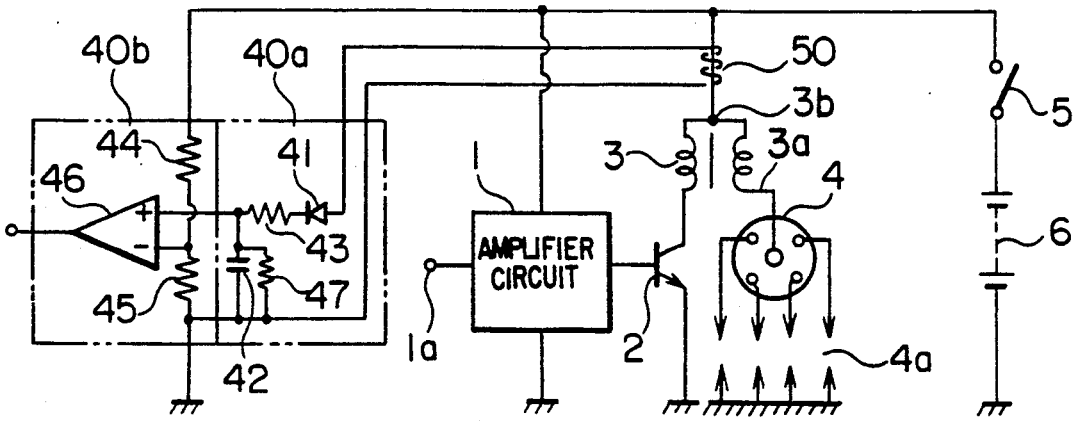
FIGS. 5 to 8 are electric circuit diagrams illustrating the third to sixth embodiments of the device of the present invention, respectively.

A third embodiment of the invention will now be described. In the third embodiment shown in FIG. 5, a detection coil 50 for spark surface current detection is wound on a positive polarity power supply line of an ignition coil 3 one end of whose secondary winding is connected to positive polarity terminal 3*b* of its primary winding. When a spark surge current generated by capacitive discharge caused by the ignition coil 3 flows from ignition plugs 4*a* through an ignition distributor 4 and an ignition coil secondary winding to the positive polarity power supply line, this current flow is detected by the detection coil 50 and the detected high frequency current is rectified through a diode 41 and charges a capacitor 42 via a resistor 43. The diode 41 and resistor 43 constitute along with the resistor 47 and capacitor 42, integration means 40*a*, which in turn constitutes, together with the detection coil 50, ignition surge current detector means. A charging voltage of the capacitor 42 is compared in a comparator 46 with a reference voltage determined by resistors 44, 45 to produce an output signal. The resistors 44, 45 and the comparator 46 constitute comparator means 40*b*. Thus, in contrast to the first and second embodiments wherein the spark surge current is detected inside the detection circuit 10*a* and 10*b*, the third embodiment utilizes the detection coil 50 provided on the spark surge current path on the ignition coil primary side, but it is obvious that similar effects are expected to be obtained.

Figure 6:
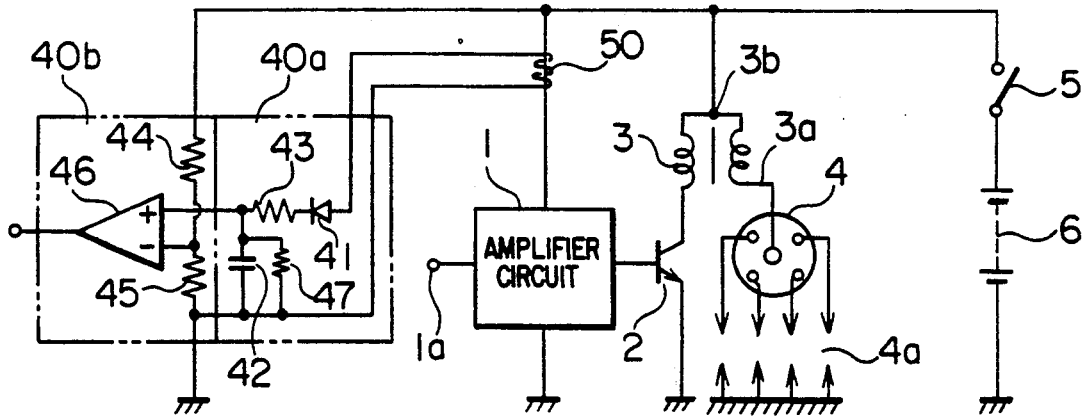
Figure 7:
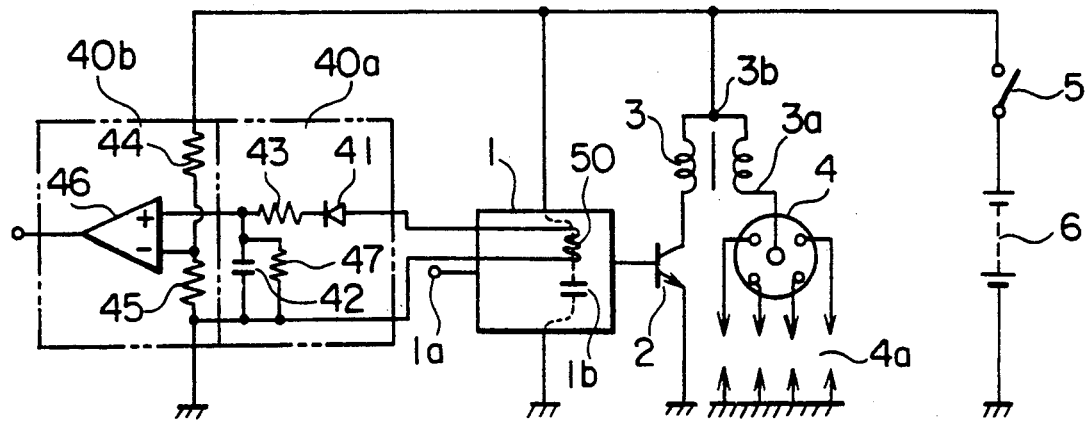

Also, line in a fourth embodiment shown in FIG. 6, a detection coil 50 may be wound on a power supply line of an ignition amplifier 1, or like in fifth embodiment shown in FIG. 7, a detection coil 50 may be wound on a power supply line for a power supply smoothing capacitor 1*b* comprised in an ignition amplifier 1. With the above constructions, it is obvious that similar effects may be expected to be obtained.

Figure 8:
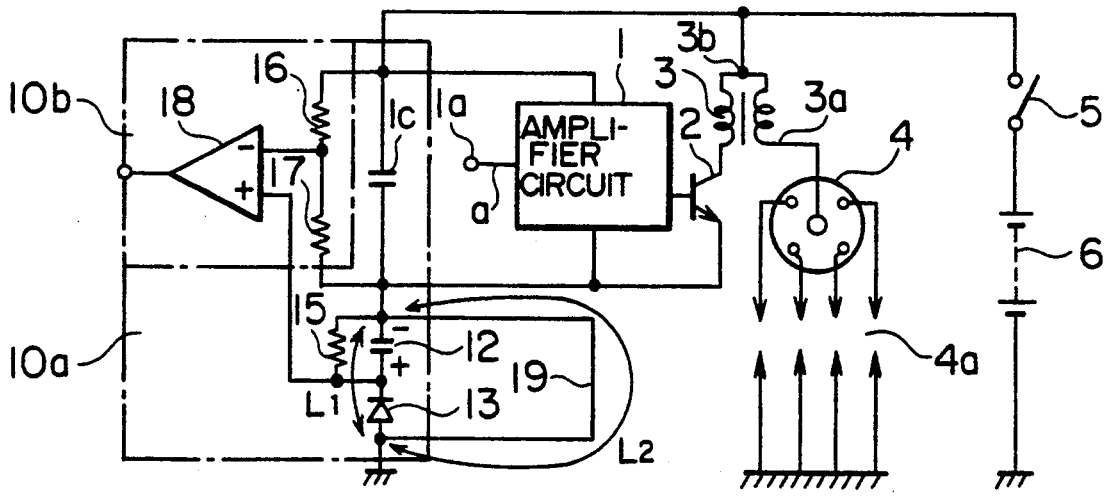

FIG. 8 illustrates a sixth embodiment of the present invention wherein, in parallel with a ground line 19 for interconnecting a junction of a ground terminal of an amplifier 1, one end of a resistor 17 and the emitter of an output transistor 2 with the ground, a series circuit of a diode 13 and a capacitor 12, which constitutes ignition surge current detector means 10*a*, is connected, and, between the ground line 19 and a primary winding positive polarity terminal 3*b*, a smoothing capacitor 1*c* is connected. In accordance with this sixth embodiment, the ground line 19 can be used to have an inductance which can provide, at an ignition surge current which is a high frequency current of about 100 MHz, an impedance or a voltage drop sufficient to render the diode 13 conductive. Accordingly, the ignition surge current due to capacitive discharge caused by an ignition coil 3 flows from ignition plugs 4*a* to the primary winding positive polarity terminal 3*b* through the ground, the diode 13, the capacitor 12 and the smoothing capacitor 1*c*, thereby charging the capacitor 12 to afford a polarity as shown. A charging voltage of the capacitor 12 is compared in comparator means 10*b* with a predetermined value to detect the presence or absence of ignition spark.

Figure 9:
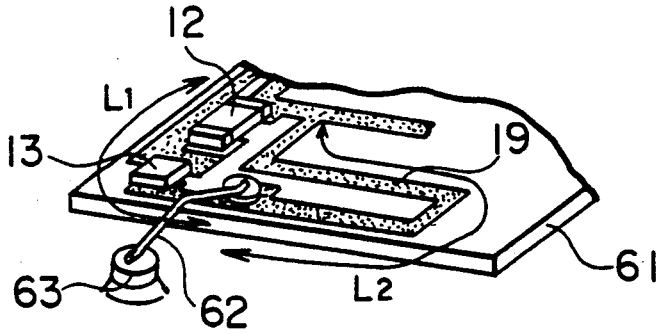
FIG. 9 is a fragmentary perspective view illustrating a practical construction of the essential part of the sixth embodiment of the present invention.
Figure 10:
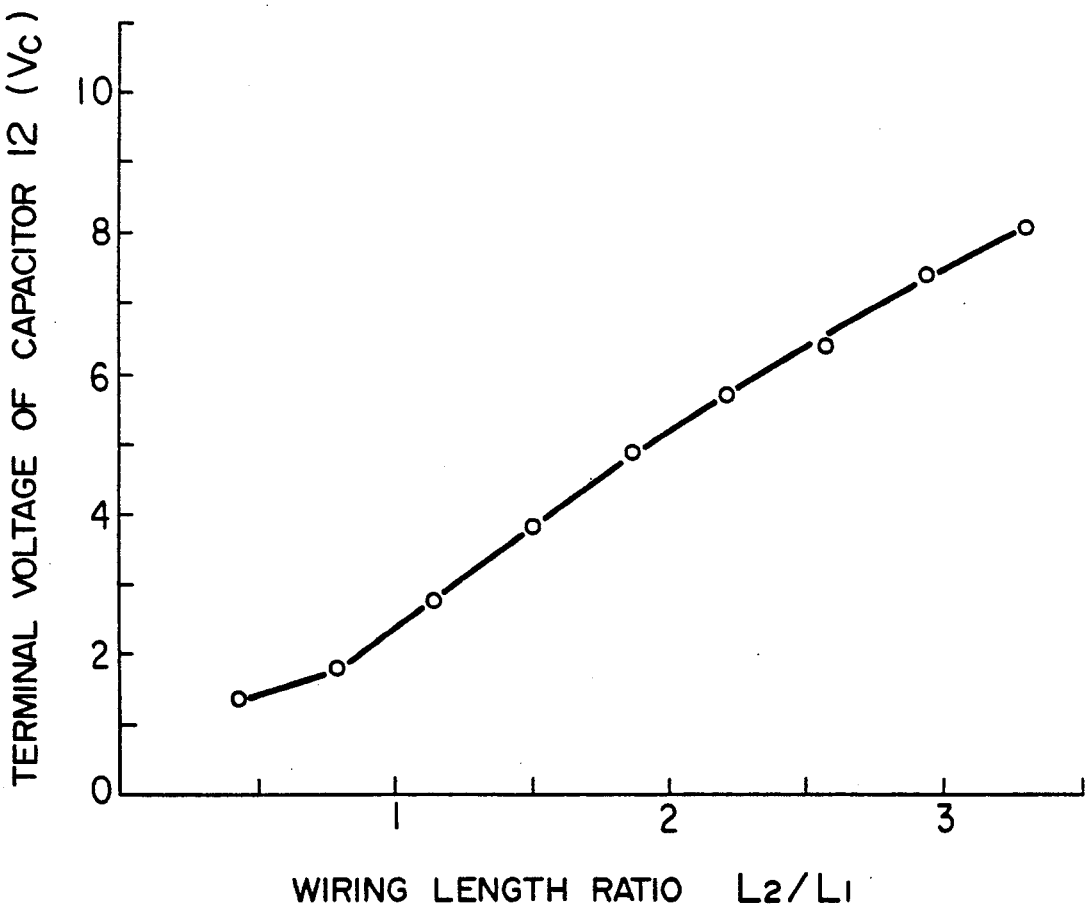
FIG. 10 is a graph showing the relation between the wiring length ratio and the capacitor terminal voltage in the sixth embodiment of the present invention.

In the case of the sixth embodiment, as illustrated in FIG. 9, the amplifier circuit 1, the ignition surge current detector means 10*a*, the comparator means 10*b* and the like are formed on a thick film substrate 61. And, connected to electrical conductors printed on the thick film substrate 61 are the capacitor 12 in the form of a chip capacitor and the diode 13 in the form of a flip chip type diode. An electrical conductor standing for the ground line 19 is grounded to a metal case 63 by way of an aluminum wire bond 62. When the series circuit of the diode 13 and the capacitor 12 has a wiring length L1 and the ground line 19 has wiring length L2, the length of the ground line 19 is varied to change a ratio L2/L1, and the relation between the ratio and the terminal voltage of the capacitor 12 at the time of normal ignition is examined. Then, a characteristic as shown in FIG. 10 is obtained, indicating that the greater the ratio L2/L1 is, the higher becomes the terminal voltage of the capacitor 12. Therefore, by using the relation between the ratio and the terminal voltage of the capacitor 12, the setting of the reference voltage of the comparator means 10*b* can be made to have a voltage slightly lower than the terminal voltage of the capacitor 12, thus making it possible to accurately check whether normal ignition spark has taken place or not. Advantageously, in the sixth embodiment utilizing the impedance of the ground line 19, the detection coil 50 employed in the third to fifth embodiments can be omitted to simplify the construction, and the voltage drop across the impedance of the ground line 19 ca be rendered immune to variations in the power supply voltage.

Obviously, if in the sixth embodiment the smoothing capacitor 1*b* is contained in the amplifier circuit 1, it is not necessary for the ignition surge current detector means 10*a* to be provided with the smoothing capacitor 1*c*.

It is to be noted that, though in the sixth embodiment the ground line 19 is connected in common to the amplifier circuit 1, the output transistor 2 and the comparator means 10*b*, the common use of the ground line 19 is not always necessary and the series circuit of the diode 13 and the capacitor 12 may be connected in parallel with at least a part of ground lines provided in association with the above components.

It is also to be noted that in the sixth embodiment the relation of connection between the diode 13 and the capacitor 12 can be exchanged so that the comparator means 10*b* may detect a negative polarity side voltage of the capacitor 12.

FIG. 11 illustrates a seventh embodiment in which, as compared with the sixth embodiment, comparator means 10*b* has a ground path separate from that of an igniter 1A, which includes an amplifier circuit 1 and an output transistor 2, and has its ground line 19 provided in the ground path of the comparator means 10*b*. An AC coupling capacitor 1*c* is connected between the ground line 19 and a primary winding positive polarity terminal 3*b* connected commonly to ignition coils 3, thereby ensuring that an ignition surge current caused by each ignition coil 3 is conducted to the ground line 19 through the AC coupling capacitor 1*c*. The ignition surge current detector means 10*a* and the comparator means 10*b* are arranged to be separate from the igniter 1A to form an ignition sensor. The thus constructed single ignition sensor is used commonly to individual ignition coils 3 provided corresponding to individual engine cylinders, and there are provided individual cylinder ignition determining means 200 operable to perform a logical operation on an output signal of the ignition sensor and an ignition signal for each cylinder in order to effect ignition detection for each cylinder.

Referring to FIG. 11, 1B designates a well known electronic control unit which is operable to receive various engine parameters such as an engine rotational speed, an engine load state, etc. so as to calculate and deliver ignition signals T1 to T4 for individual cylinders. Denoted by 60 is an ignition detection pulse generator circuit operative to receive signals obtained by the differentiation of falling portions of the ignition signals T1 to T4 from the individual cylinder ignition determining means 200 and an output signal of the comparator means 10*b* and to output ignition detection pulses, the ignition detection pulse generator circuit 60 comprising transistors 61 to 64, resistors 65 to 69 and a delay circuit 70. Denoted by 80 is a constant voltage circuit connected to receive an output voltage of a battery 6 to produce a constant output voltage. The number of the individual cylinder ignition determining means 200 is equal to the number of engine cylinders. Each individual cylinder ignition determining means 200 comprises transistors 201 to 206, resistors 207 to 216, a capacitor 217, a diode 218, and logical elements 219 and 220. Denoted by 300 are display units respectively connected to the outputs of the individual cylinder ignition determining means 200 to display the ignition state of individual engine cylinders by means of light emitting diodes.

The operation of the seventh embodiment will now be described by referring to operation waveform diagram of FIGS. 12(A)-(H). FIGS. 12(A)-(H) illustrates at T1 to T4 ignition signals outputted from the electronic control unit (ECU) 1B corresponding to individual cylinders, the individual ignition plugs 4*a* being caused to fire at the falling edges of the individual ignition signals. Accordingly, the comparator means 10*b* delivers, in the state of normal ignition, positive pulses as shown in FIG. 12(A) immediately after each ignition time. On the other hand, the individual ignition signals T1 to T4 applied to the ignitor 1A are branched respectively to the individual cylinder ignition determining means 200. Each ignition signal for each cylinder supplied to each individual cylinder ignition determining mean 200 is differentiated by the transistor 201 and capacitor 217, thus producing a differential pulse at the falling edge of the ignition signal T1, T2, T3 or T4, as shown in FIG. 12(B). Then, in the state of normal ignition, the ignition detection pulse generator circuit 60 operates to generate at the collector of the transistor 64 an ignition detection pulse as shown in FIG. 12(C) during a short interval of time from the falling edge of the ignition signal T1, T2, T3 or T4 to the time of generation of the ignition detection pulse shown in FIG. 12(A) in the comparator means 10*b*. However, if ignition corresponding to one of the ignition signals T1 to T4, for example, the ignition signal T4, has failed at time $t_1$ to give rise to misfiring, an ignition pulse having a long duration time from the falling edge of the ignition signal T4 to time $t_2$, at which ignition corresponding to the succeeding ignition signal T1 occurs, is generated by the transistor 64 of the ignition detection pulse generator circuit 60. The ignition detection pulses ar delayed through the delay circuit 70 so that the ignition detection pulse generator circuit 60 produces an output signal waveform as shown at FIG. 12(D). Thus, it is noted that the ignition state of an engine cylinder can be determined in accordance with the waveform in FIG. 12(D), by deciding whether the waveform of a delayed ignition detection pulse is at high or low level at the timing of the falling edge of an ignition signal for the succeeding cylinder. More specifically, in the case that an ignition failure occurs in an engine cylinder corresponding to the ignition signal T4 at time $t_1$ as shown in FIG. 12, a pulse signal waveform as shown in FIG. 12(E) generated in synchronism with the falling edge of the succeeding ignition signal T1 in an individual cylinder ignition determining circuit 200 corresponding to the ignition signal T1 is subjected to a logical operation with the delayed ignition pulse signal FIG. 12(D) waveform corresponding to the ignition signal T4 by means of the logical elements 219 and 220 included in the individual cylinder ignition determining circuit 200 corresponding to the ignition signal T4. The logical elements 219 and 220 then produce output signals as shown in FIG. 12(F) and 12(G), respectively, which in turn are used to drive a flip-flop circuit comprised of the transistors 204, 205 and resistors 213 to 216, thereby providing an ignition determination signal waveform as shown in FIG. 12(H) for each associated cylinder.

The ignition determination signal then drives a display unit 300 associated with the corresponding cylinder so that the display unit 300 is operated to turn on, for example, a light emitting diode, thereby making it possible for a user to visually confirm an engine cylinder which is subject to ignition failure.

Figure 13:
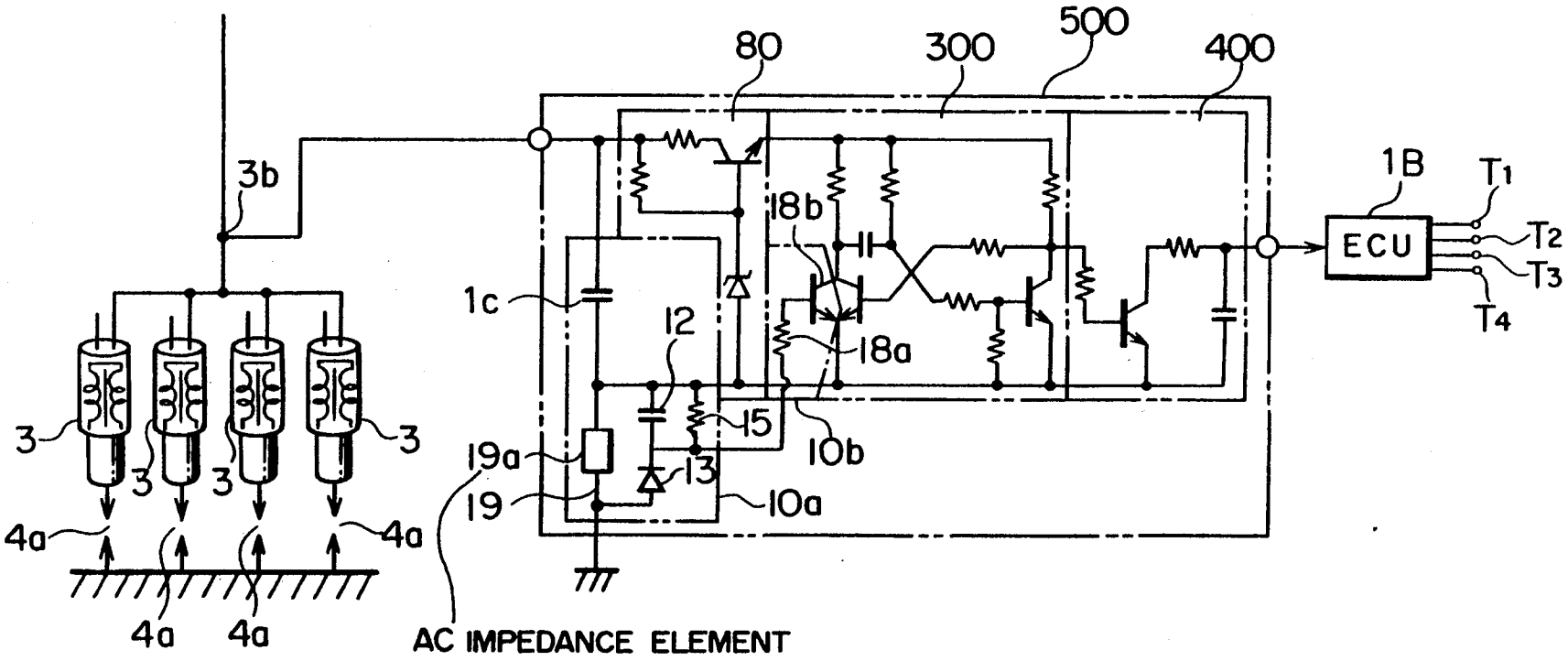

FIG. 13 shows an eighth embodiment of the present invention in which, as compared with the seventh embodiment, the function of the individual cylinder ignition determining means 200 is implemented by software of a microcomputer in an electronic control unit 1B so that fuel injection to a cylinder associated with an ignition plug 4*a*, at which ignition failure has occured, may be stopped.

Referring to FIG. 13, reference numeral 19*a* designates an AC impedance element, such as resistance, inductance or the like, provided in the ignition surge current detector means 10*a*. The AC impedance element 19*a* is inserted in a ground line 19 so that it may be effective in increasing the value of an AC impedance of the ground line 19 when it is too small. The comparator means 10*b* is composed of a resistor 13*a* and a transistor 18*b*.

Denoted by 300 is a monostable multivibrator which is triggered by an output signal of the comparator means 10*b* to produce an output pulse of a predetermined time width (for example, 1.5 ms), and denoted by 400 is an output circuit constructed to supply an output signal from the monostable multivibrator 300 to the electronic control unit 1B. All the aforesaid circuits 10*a*, 10*b*, 300 and 400, along with a constant voltage circuit 80 are incorporated to form an ignition sensor 500 which is separated from the igniter 1A shown in FIG. 11 and the electronic control unit 1B.

The separate provision of the ignition sensor 500 as described above permits the provision of the ignition sensor 500 in the form of a discrete attachment without requiring to change the internal construction of the igniter 1A and the electronic control unit 1B, thus increasing the degree of freedom of design.

As described above, in the ignition detecting device according to the present invention, an ignition surge current due to capacitive discharge caused by the ignition coil, which ignition surge current is generated in the primary side circuit of the ignition coil, is detected by the ignition surge current detector means, and in accordance with the output signal of the ignition surge current detector means, an ignition surge current in excess of a predetermined value occurring in the primary side circuit of the ignition coil is detected by the comparator means. Thus, it is made possible to accurately detect the occurrence or nonoccurrence of ignition spark on the basis of the ignition surge current due to capacitive charge caused by the ignition coil which ignition surge current is generated in the primary side circuit of the ignition coil. Further, since it is not necessary to lead any secondary high voltage of the ignition coil into the electronic circuit, it becomes possible to simplify insulating means and consequently to minimize the size of the device and to reduce the manufacturing cost of the device.

I claim:

1. An ignition detecting device for detecting an ignition spark in an ignition system having an ignition coil with a primary and a secondary winding connected to a primary and a secondary side circuit, respectively, and generating means for generating a capacitive discharge through said secondary winding of the ignition coil to produce the ignition spark, said ignition detecting device comprising:

ignition surge current detector means for detecting an ignition surge current in said primary side circuit due to said capacitive discharge in said secondary side circuit;

comparator means responsive to an output signal of said ignition surge current detector means for detecting an ignition surge current in excess of a predetermined value as determining the presence of an ignition spark; wherein said primary side circuit includes a DC power supply having a first and second electrode, said first electrode connected to a first end of said primary winding, said second electrode is grounded; and a switching mans having a first end connected to a second end of said primary winding and a second end of said switching means is grounded, said switching means turned on and off in response to an ignition signal;

said secondary side circuit includes ignition plugs in which a first end of each of said ignition plugs is connected to a first end of said secondary winding and a second end of each of said plugs is grounded, and a second end of said secondary winding is connected to said primary winding;

said ignition surge current detector means includes a series circuit of a first diode and a first capacitor connected between ground and a junction between said primary and secondary windings, said first capacitor being charged through said first diode by an ignition surge current of a first polarity generated in said secondary side circuit, and a series circuit of a second diode and second capacitor connected between ground and a junction between said first diode and said first capacitor, said second capacitor being charged through said second diode and said first capacitor by an ignition surge current of a second polarity generated in said secondary side circuit; and said comparative means compares a voltage on said second capacitor with said predetermined value.

2. An ignition detecting device according to claim 1, wherein the second end of the secondary winding is connected to the first end of the primary winding.

3. An ignition detecting device for detecting an ignition spark in an ignition system having an ignition coil with a primary and a secondary winding connected to a primary and a secondary side circuit, respectively, and generating means for generating a capacitive discharge through said secondary winding of the ignition coil to produce the ignition spark, said ignition detecting device comprising:

ignition surge current detector means for detecting an ignition surge current in said primary side circuit due to said capacitive discharge in said secondary side circuit;

comparator means responsive to an output signal of said ignition surge current detector means for detecting an ignition surge current in excess of a predetermined value as determining the presence of an ignition spark; wherein said ignition surge current detector means includes a detection coil wound on a power supply line of said primary side circuit to detect an ignition surge current in said power supply line, and integration means for rectifying and integrating a voltage induced in said detection coil; and said comparative means compares an output value of said integration means with said predetermined value.

4. An ignition detecting device according to claim 3, wherein:

said primary side circuit includes a DC power supply having a first and second electrode, said first electrode connected to a first end of said primary winding and said second electrode is grounded; and a switching means having a first end connected to a second end of said primary winding and a second end of said switching mans grounded, and switching means responsive to an ignition signal to be turned on and off;

said secondary side circuit includes ignition plugs a first end of each of which is connected to a first end of said secondary winding and a second end of each ignition plug is grounded;

a second end of said secondary winding is connected to said primary winding; and said detection coil is wound on the power supply line interconnecting a junction between said first end of said primary winding, said second end of said secondary windings and said first electrode of said DC power supply.

5. An ignition detecting device according to claim 4, wherein the second end of the secondary winding is connected to the first end of the primary winding.

6. An ignition detecting device according to claim 3, wherein said primary side circuit includes:

an amplifier circuit for amplifying an ignition signal;

an output transistor responsive to an output signal of said amplifier circuit for turning a primary current flowing through said primary winding on and off; and said detection coil is wound on a power supply line of said amplifier circuit.

7. An ignition detecting device for detecting the presence/absence of an ignition spark in an ignition apparatus having a primary and secondary winding of an ignition coil connected to a primary and secondary side circuit, respectively, and generating means for generating a capacitive discharge through said secondary winding of the ignition coil to produce ignition spark, said ignition detecting device comprising:

ignition surge current detector means for detecting an ignition surge current due to said capacitive discharge;

said ignition surge current detector including a detection coil wound on a power supply line of said primary side circuit to detect an ignition surge current in said power supply line, and integration means for rectifying and integrating a voltage induced in said detection coil; and comparator means responsive to an output signal of said ignition surge current detector means for detecting an ignition surge current in excess of a predetermined value for determining the presence/absence of an ignition spark;

said comparator means compares an output value of said integration means with said predetermined value;

said primary side circuit includes an amplifier circuit for amplifying an ignition signal, said amplifier circuit including a smoothing capacitor, an output transistor responsive to an output signal of said amplifier circuit for turning a primary current flowing through said primary winding on and off; and said detection coil being wound on a power supply line of said smoothing capacitor.

8. An ignition detection device for detecting the presence/absence of ignition spark in an ignition apparatus having a primary and secondary winding of an ignition coil connected to a primary and secondary side circuit, respectively, said ignition detection device comprising:

said primary side circuit including a DC power supply having a first and second electrode, said first electrode connected to a first end of said primary winding and said second electrode being grounded; and a switching means having a first end connected to said second end of said primary winding and a second end of said switching means grounded; said switching means responsive to an ignition signal to be turned on and off;

a secondary side circuit including ignition plugs a first end of each ignition plug is connected to a first of said secondary winding and a second end of each ignition plug is grounded, a second end of said secondary winding being connected to said primary winding;

ignition surge current detector means including a series circuit of a diode and a capacitor connected in parallel with a ground line of said primary side circuit, said capacitor being charged through said diode by an ignition surge current of one polarity generated in said secondary side circuit; and comparator means for comparing a charging voltage of said capacitor with a predetermined value and detecting an ignition surge current in said secondary side circuit when said charging voltage exceeds said predetermined value.

9. An ignition detecting device for use in an internal combustion engine having a plurality of ignition coils corresponding to the number of cylinders of the internal combustion engine, according to claim 8, further comprising:

a plurality of said ignition surge current detector means and a plurality of said comparator means provided in association with each of said ignition coils; and a plurality of validation means for validating that a detection output signal of each of said comparative means is output at normal ignition timing.

10. An ignition detecting device for use in an ignition apparatus according to claim 8, wherein an AC impedance element is comprised in said ground line.

11. An ignition detecting device according to claim 8, wherein the second end of the secondary winding is connected to the first end of the primary winding.

12. An ignition detecting device for detecting the presence/absence of ignition spark in an ignition apparatus having a primary and secondary winding of an ignition coil connected to a primary and secondary side circuit, respectively, said ignition detection device comprising:

said primary side circuit includes a DC power supply having a first and second electrode, said first electrode connected to a first end of said primary winding and said second electrode is grounded; and a switching means having a first end connected to a second end of said primary winding and a second end of said switching means grounded, said switching means responsive to an ignition signal to be turned on and off;

a secondary side circuit including ignition plugs, a first end of each ignition plug is connected to a first end of said secondary winding and a second end of each ignition plug is grounded, a second end of said secondary winding being connected to said primary winding;

ignition surge current detector means including a series circuit of a diode and a capacitor connected in parallel with a ground line of said primary side circuit, said capacitor being charged through said diode by an ignition surge current of one polarity generated in said secondary side circuit;

comparator means for comparing a charging voltage of said capacitor with a predetermined value and detecting an ignition surge current in said ignition surge current detector means when said charging voltage exceeds said predetermined value;

said switching means comprising an igniter including an amplifier circuit for amplifying the ignition signal, and an output transistor responsive to an output signal of said amplifier circuit to turn on and off a primary current flowing through said primary winding;

a ground line provided separately from a ground path of said igniter and forming a ground path of said comparator means; and an AC coupling capacitor connected between said ground line and an ungrounded side of said DC power supply, thus an ignition surge current generated in said ignition coil is conducted through said ground line to said AC coupling capacitor, and said ignition surge current detector means and said comparator means are provided separately from said igniter to form a discrete ignition sensor.

13. An ignition detecting device for use in an ignition apparatus of an internal combustion engine having a plurality of ignition coils corresponding to the number of cylinders of the internal combustion engine according to claim 12, wherein:

a single ignition sensor provided commonly to said plurality of ignition coils; and an ignition determining means for performing a logical operation on an output signal of said single ignition sensor and an ignition signal from each cylinder for detecting an ignition spark for individual cylinders.

14. An ignition detecting device according to claim 12, wherein the second end of the secondary winding is connected to the first end of the primary winding.

15. An ignition detecting device for detecting an ignition spark in an ignition system having an ignition coil with a primary and a secondary winding connected to a primary and secondary side circuit, respectively, and generating means for generating a capacitive discharge through said secondary winding of the ignition coil to produce the ignition spark, said ignition detecting device comprising:

ignition surge current detector means for detecting an ignition surge current in said primary side circuit due to said capacitive discharge in said secondary side circuit; and comparator means responsive to an output signal of said ignition surge current detector means for detecting an ignition surge current in excess of a predetermined value as determining the presence of an ignition spark.

16. An ignition detection device for use in an internal combustion engine having a plurality of ignition coils corresponding to the number of cylinders of the internal combustion engine according to claim 15 further comprising:

a plurality of ignition surge current detector means and a plurality of comparator means provided in association with each of said ignition coils; and a plurality of validation means for validating that a detection output signal from of each of said comparator means is output at normal ignition timing.

* * * * *